United States Patent [19]

Ryan

[11] Patent Number: 4,556,114

[45] Date of Patent: Dec. 3, 1985

[54] SOIL SAMPLER DEVICE

[76] Inventor: Michael C. Ryan, Box 426, Mitchellville, Iowa 50169

[21] Appl. No.: 480,251

[22] Filed: Mar. 30, 1983

[51] Int. Cl.[4] ..... E21B 25/00; A01B 45/06

[52] U.S. Cl. ..... 175/20; 175/249; 111/98; 171/56; 172/22

[58] Field of Search ..... 175/19, 20, 135, 161, 175/162, 339, 254, 255, 405, 414, 308, 244, 220, 313; 294/50.5, 50.6, 50.7, 50.9; 73/864.44; 111/89, 92, 98; 172/21, 22, 18; 171/56

[56] References Cited

U.S. PATENT DOCUMENTS

| | | | |
|---|---|---|---|
| 287,677 | 10/1883 | Higinsotham | 294/50.9 |
| 1,860,963 | 5/1932 | Smith | 294/50.5 |
| 2,361,005 | 10/1944 | Baer | 111/92 |
| 2,865,315 | 12/1958 | Goldstein | 111/92 |

*Primary Examiner*—James A. Leppink
*Assistant Examiner*—Bruce M. Kisliuk
*Attorney, Agent, or Firm*—Rudolph L. Lowell

[57] ABSTRACT

The soil sampler device has a cylindrical tubular shaped body member, one end portion of which is formed into a soil receiving section comprised of a pair of transversely opposite semicylindrically shaped half members one of which is integral with the body member and the other of which is cut from the body member for movable support thereon into and out of a cylinder forming relation with the integral or stationary half member. The movable member is guided into the cylinder forming relation with the stationary member on ground insertion of the device and such relation is maintained by the pressure applied on a footrest projected laterally from the movable member. An inlet opening of reduced diameter for the soil receiving section provides for a friction free travel of the soil sample material throughout the length of such section, with the sample being removed for testing by merely being dropped from the stationary member when the movable member is out of the cylinder forming relation.

6 Claims, 7 Drawing Figures

SOIL SAMPLER DEVICE

BACKGROUND OF THE INVENTION

Devices for removing soil samples or cores are well known but are generally inefficient or inconvenient to manipulate for their intended purpose of easily forming and then readily utilizing the sample for testing. Thus, as shown in U.S. Pat. No. 3,273,930 the soil core is gripped by cutting teeth to facilitate removal of the device from the ground. However, the core must be pushed from the device by a hand actuated piston. In U.S. Pat. No. 4,117,896 the sample is tested while in the device and is then cleared from the device so that the device is not used to form a soil core. Coring devices for baled materials are shown in U.S. Pat. Nos. 2,378,484 and 2,821,086. These devices are primarily concerned with shearing or cutting the material for travel within a chamber to form a core that is removed by opening one end of the core chamber.

The weed pulling devices of U.S. Pat. Nos. 287,677 and 1,407,232 utilize soil receiving sections which comprise a fixed jaw and a movable jaw that are in a spaced relation during ground insertion and wherein the weed and soil are ejected on removal of the device from the ground by a spring or hand actuated means.

The device of this invention is readily insertable into the ground to provide for the ground removal of a unitary soil core that is readily released from the core receiving section of the device by merely opening the core chamber and permitting the core to drop outwardly therefrom.

SUMMARY OF THE INVENTION

The soil sampler device is of a simple and rugged construction and efficient in operation to form a soil sample which is easily removable from the device for testing purposes without the use of removing tools or the like. The tubular cylindrical body member has a coaxial soil receiving section formed by a pair of semicylindrical half members one of which constitutes a stationary jaw member and the other of which a movable jaw member that is pivotally supported on the body member for movement into and out of a cylinder forming relation with the stationary jaw. The coacting guide means on the jaw members holds the movable jaw and stationary jaw against relative lateral and twisting movements when in the cylinder forming relation. The reduced cross sectional area of the inlet of the soil receiving section and the sharp cutting edge on the peripheral rim of the inlet reduces friction of the soil to be sampled to a minimum so that a unitary soil sample is readily obtained on opening of the soil receiving section.

DESCRIPTION OF THE INVENTION

Figures 1, 2, 3, 4, 5:
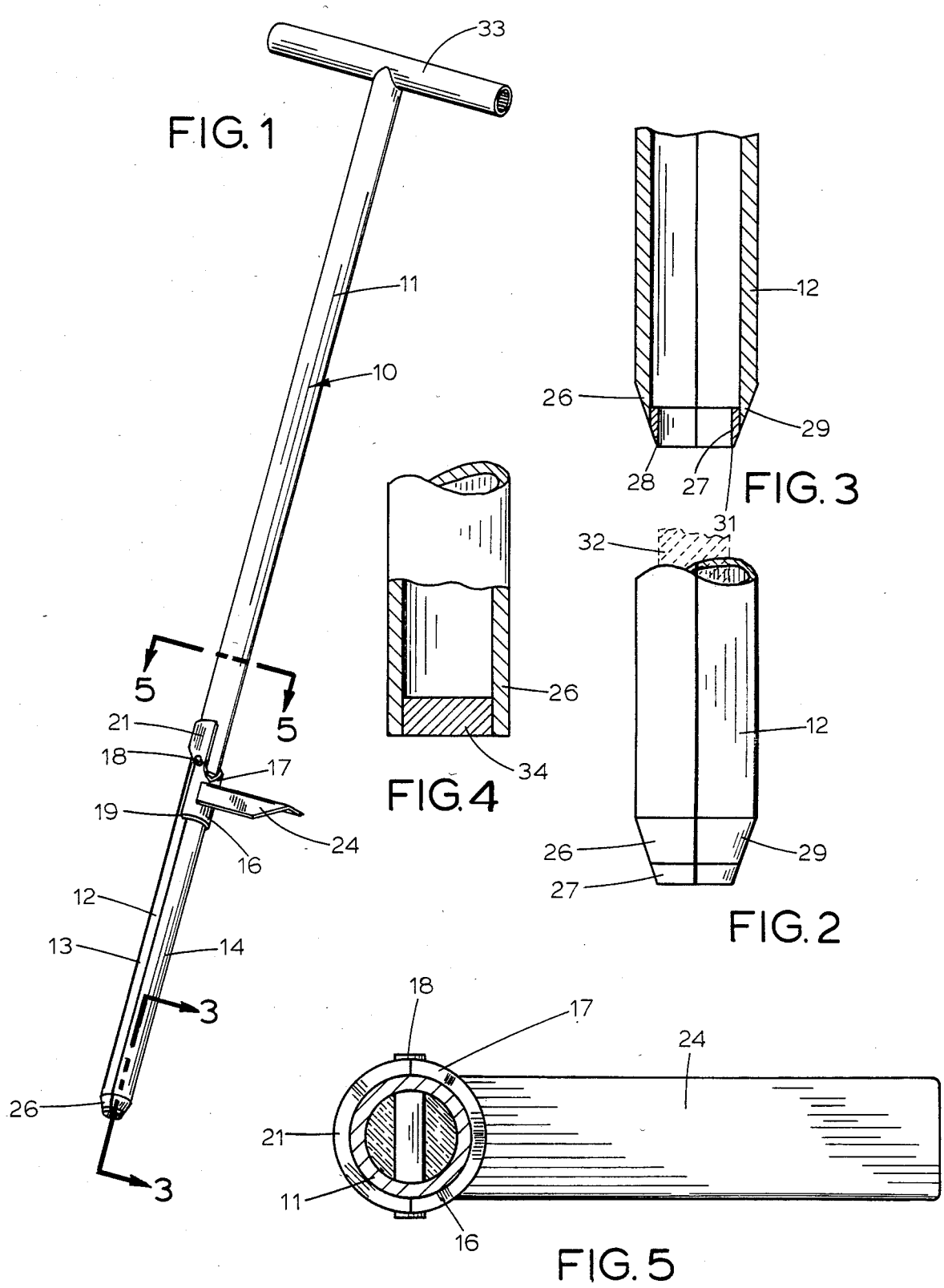
FIG. 1 is a perspective view of the soil sampler device of this invention with the parts thereof arranged for ground insertion.
FIG. 2 is an enlarged side elevational view of the inlet end of the soil receiving section of the deivce.
FIG. 3 is an enlarged sectional view of the inlet end of the soil receiving section as seen on the line 3—3 in FIG. 1.
FIG. 4 is an elevational view of the inlet end of the soil receiving section with parts broken away to show a step in the construction thereof.
FIG. 5 is an enlarged cross sectional view taken on line 5—5 in FIG. 1.

Referring to the drawings, the sampler device of this invention, as shown in FIG. 1, includes an elongated tubular body member 10, illustrated as being of a cylindrical shape, and having an upper main section 11 and a lower sample receiving section or core chamber 12. The core chamber 12 (FIGS. 1 and 2) is comprised of a pair of similar transversely opposite half members 13 and 14 formed from the tubular body member 10 with the half member 13 being integral with and constituting a longitudinal extension of the main section 11. The half member or movable jaw 14 is secured to one end portion 16 of a lever 17 that is pivoted intermediate the ends thereof at 18 on the main section 11 adjacent its junction with the stationary jaw 13. On movement of the lever 17 about the pivot 18, the movable jaw 14 is pivotally moved into and out of a cylinder or tube forming relation with the stationary jaw 13.

Figure 6:
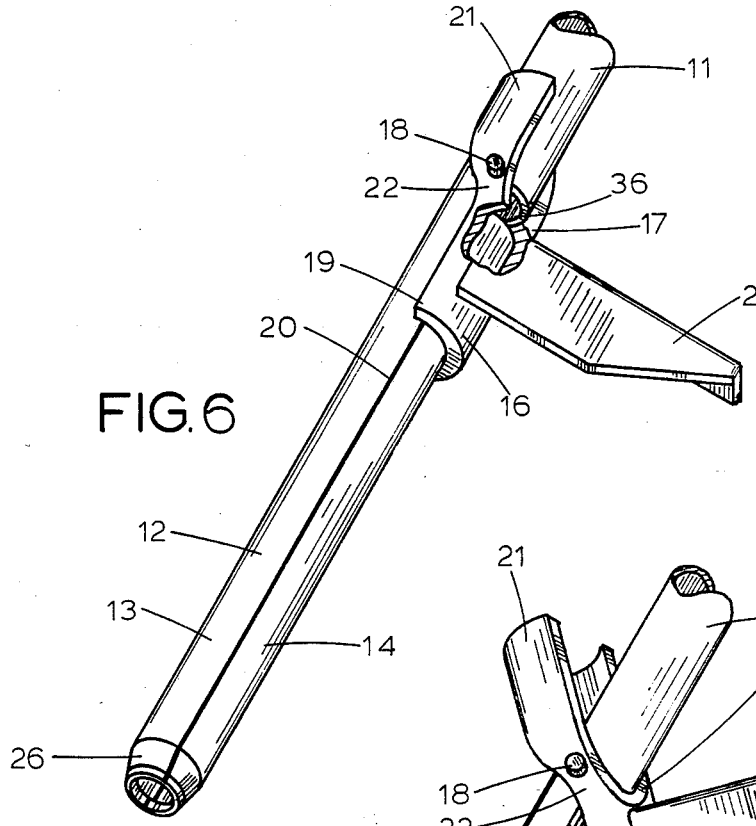
FIG. 6 is an enlarged detail perspective view of the soil receiving section of the device shown in closed position and with parts thereof broken away to more clearly show its construction.
Figure 7:
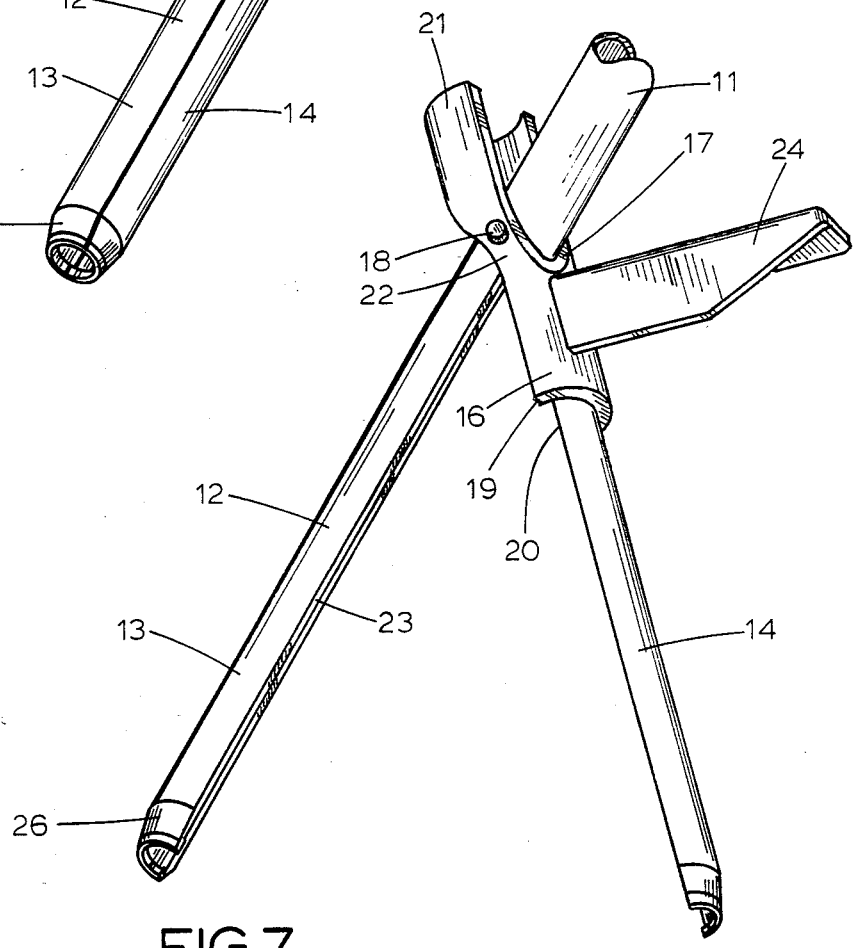
FIG. 7 is illustrated similarly to FIG. 6 and shows the soil receivng section in an open position to permit the removal of a soil sample therefrom.

The end portion 16 of the lever 17 is of a semicircular shape to receive in nesting engagement the movable jaw 14 with the side portions 19 thereof projected laterally from the adjacent side portions 20 of the movable jaw 14 (FIGS. 6 and 7). The end portion 21 of the lever 17 is also of a semicircular shape in transverse cross section and is adapted to receive in nesting and abutting engagement the main section 11 when the movable jaw 14 is in the cylinder forming relation therefor (FIG. 5). It is seen, therefore, that the lever end portions 16 and 21 have the concave surfaces thereof facing in opposite directions and that the end portions are joined together by connecting sections 22 which straddle the body member 10. The pivot 18 is extended through the connecting sections 22 and transversely of the body member 10.

When the jaw members 13 and 14 are in the cylinder forming relation to close the core chamber 12, the side edges 19 of the lever end portion 16 overlie in contact engagement the adjacent side edges 23 of the stationary jaw 13. The side edges 19 and 23 thus constitute a means for guiding the movable jaw 14 into its cylinder forming relation with the stationary jaw 13 and complements a similar guiding action that takes place between the lever end portion 21 and the main section 11.

A foot rest 24 secured to and projected laterally from the lever end portion 16 is integrally assembled with the lever 17 and movable jaw 14. The movable jaw is thus actuated to a jaw closing position by a downward pressure applied on the foot rest 24 and with the continued application of pressure providing for the ground insertion of the device. Importantly the applied ground insertion pressure functions to positively hold the movable jaw member 14 in its closed or cylinder forming relation with the stationary jaw 13 against lateral and twisting movements out of concentricity with the stationary jaw.

To facilitate the ground insertion of the device, the inlet or terminal end 26 of the soil receiving section 12 is provided with an insert 27 of a flat ring shape (FIG.

3) such that the outer edge 28 of the insert constitutes the end face of the inlet 26. As a result, the inner cross sectional area of the insert 27 is of a reduced size relative to the inner cross sectional area of the soil receiving section 12. With the insert 27 secured within the inlet 26, the outer surface of the inlet is tapered as indicated at 29 to form a cutting edge 31 on the insert edge 27 of a diameter substantially equal to the inner diameter of the insert. The soil core, shown in dotted lines 32 in FIG. 2, thus has an outer diameter substantially equal to the inner diameter of the insert so that it is permitted to move substantially friction free within the soil receiving chamber 12 over the full length thereof.

The outer tapered surface 29 of the insert 27, as the device is inserted into the ground, tends to compress the soil laterally outwardly so that the counteracting laterally directed inward force of the compressed soil aids in maintaining the jaws 13 and 14 in a closed relation.

In use, (FIG. 1) the movable jaw 14 is closed and with the device hand gripped at the handle 33 on the upper end of the body member 10, foot pressure is applied on the rest member 24 for ground insertion of the device to a desired depth. The device is then removed from the ground and while the device is held in a horizontal position the stationary jaw 13 is faced concavely upwardly below the movable jaw, the foot rest 24 is manually actuated to open the core chamber 12. With the movable jaw 14 in a wide open position the stationary jaw 13 is then faced concavely downwardy whereby to freely release the core sample 32 therefrom.

In the construction of the soil receiving section 12 (FIG. 4) a disc 34, which is drilled into a flat ring shape to form the insert 27, is initially secured within the inlet 26 after which the taper 29 is formed to provide the cutting edge 28. The body member 10 over the length of the soil section 12 is then cut into the half members 13 and 14, as by a bank saw, and the movable jaw 14 removed by cutting the body member at 36 (FIG. 6). With the foot rest 24 secured to the lever end portion 16, the lever is pivotally connected to the main section 11. The handle 33 is then attached to the body member 10 by welding means or the like.

Athough the invention has been described with respect to a preferred embodiment thereof, it is to be understood that it is not to be so limited since changes and modifications can be made therein which are within the full intended scope of this invention as defined by the appended claims.

I claim:

1. A soil sampler device comprising:

(a) an elongated tubular body member having a main section and a soil receiving section, (b) said soil receiving section including a pair of transversely opposite half portions one of which forms a stationary extension projected longuitudinally from said main section and the other of which an extension movable into and out of a tube closing relation with said stationary extension, (c) means movably supporting said movable extension on said main section for movement into and out of said tube closing relation, (d) a foot rest member secured to and projected laterally outwardly from said movable extension, and (e) coacting means on said stationary extension and movable extension on the opposite side of the movable supporting means from said foot rest for guiding said movable extension into said tube closing relation in response to pressure applied on said foot member for ground insertion of said soil receiving section.

2. The soil sampler device according to claim 1, including:

(a) an inlet for said soil receiving section having transversely opposite coacting portions at the terminal ends of said stationary extension and movable extension, (b) said coacting portions, when the stationary extension and movable extension are in said tube closing relation, forming an opening of a reduced cross sectional area relative to the inner cross sectional area of said receiving section.

3. The soil sampler device according to claim 1, wherein:

(a) said supporting means includes a lever member secured to said movable extension, and (b) pivot means extended transversely of the tubular body member adjacent the junction of said stationary extension and main section pivotally supporting said lever member for pivotal movement of the movable extension into and out of said tube closing relation.

4. The soil sampler device according to claim 2, wherein:

(a) said inlet opening has the outer side thereof of a tapered contour to provide a cutting edge about the outer end thereof.

5. The soil sampler device according to claim 3, wherein:

(a) said lever member has a first end portion secured to said movable extension and located to one side of said pivot means, and a second end portion located to the opposite side of said pivot means whereby, said pivot means is intermediate the adjacent ends of said first end portion and second end portion, so that when said movable extension and stationary extension are in a tube closing relation said second end portion is in abutting engagement with said main section.

6. The soil sampler device according to claim 5, wherein:

(a) said tubular body member is of a cylindrical shape and said first end portion and second end portion of the lever member are of a semicylindrical shape, and (b) said coacting means includes first coacting portions on said stationary extension and on said first end portion and second coacting portions on said main section and on said second end portion.

* * * * *